United States Patent [19]

Coppolani et al.

[11] 4,049,124

[45] Sept. 20, 1977

[54] SORTING MACHINE FOR ELONGATED ARTICLES

[75] Inventors: Joseph Coppolani, Meudon la Foret; Léon Vandernotte, Rueil-Malmaison, both of France

[73] Assignee: Societe Franco-Europeenne de Material pour l'Industrie Alimentaire "F.E.M.I.A" France, Paris, France

[21] Appl. No.: 670,269

[22] Filed: Mar. 25, 1976

[30] Foreign Application Priority Data

Apr. 2, 1975 France ..... 75.10243

[51] Int. Cl.[2] ..... B07C 5/04

[52] U.S. Cl. ..... 209/98; 209/106

[58] Field of Search ..... 209/97, 98, 99, 101, 209/106, 107, 108, 73, 74

[56] References Cited

U.S. PATENT DOCUMENTS

| | | | |
|---|---|---|---|
| 2,099,223 | 11/1937 | Paxton | 209/106 |
| 2,984,351 | 5/1961 | Slyck et al. | 209/98 |
| 3,241,667 | 3/1966 | Grosbety | 209/98 |

*Primary Examiner*—Robert B. Reeves
*Assistant Examiner*—Joseph J. Rolla
*Attorney, Agent, or Firm*—James & Franklin

[57] ABSTRACT

An adjustment assembly is provided for a sorting machine for elongate articles, e.g. string beans, for adjusting the inter-bar spacing between the alternating fixed and movable bars of the rotary drum thereof, and is operative when the parts of the sorting machine are in motion. The movable bars are mounted for displacement in radial slots in peaked elements extending outwardly of the drum. Springs are run around pulleys mounted on the movable bars for urging the movable bars toward a limit position in their slots. An inclined cam member is associated with each movable bar and has a camming surface cooperating with a cam followers slidably mounted on its movable bar. Forked slide control members control the sliding of the cam followers along their movable bars and are received in grooves of pairs of adjacent cam followers. All the slide control members are moved in unison by an adjustment ring mounted independent of the rotary drum and parallel to the axis thereof.

9 Claims, 2 Drawing Figures

SORTING MACHINE FOR ELONGATED ARTICLES

Figure 1:
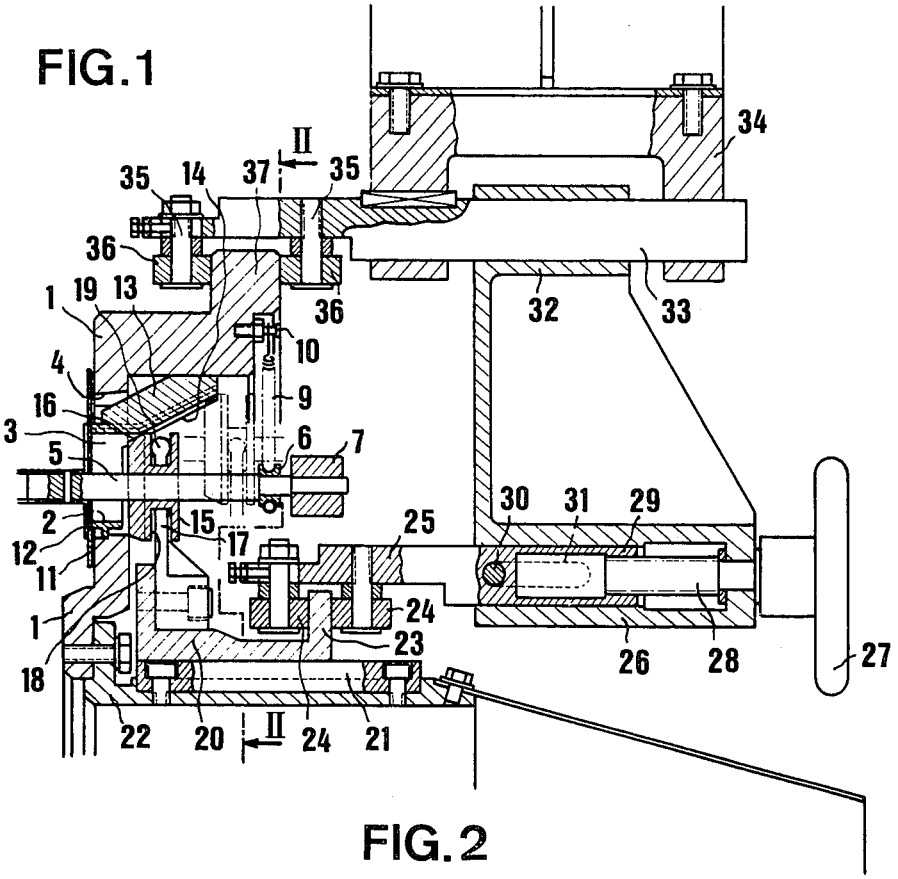

The present invention relates to sorting machines for vegetables, particularly green beans, or other elongate articles of the type comprising a rotary drum formed of longitudinal bars which are alternately radially fixed and movable, the relative spacing therebetween being adjustable.

More particularly, the invention concerns sorting machines comprising fixed bars which are troughlike and V-shaped in cross-section and movable bars which are cylindrical and displaceable radially of the drum in fixed guideways.

An aim of the invention is to provide in-motion adjustable means, i.e., not requiring the stopping of the sorting machine, for the inter-bar spacing between the fixed bars and the movable bars.

In a known type of sorting machine, the movable bars are adapted to be displaced in fixed radial grooves by means of return springs and a fixed camming suface, e.g. inclined camming surfaces, on the drum of the sorting machine angularly displaceable to vary the position of each movable bar in its groove, i.e., with respect to two adjacent V-shaped troughlike fixed bars.

The adjustment of the inter-bar spacing of such sorting machines is not possible when the machine is in operation. Moreover, such adjustment is not easy owing to the parts of the machine not being in motion, the articles being sorted jamming between the bars and the friction surfaces being rather extensive.

In order to obviate these drawbacks, the invention provides an inter-bar spacing adjustment assembly for adjusting the spacing between fixed and movable bars of a sorting machine for elongate articles such as vegetables while the machine is in operation, comprising radial grooves accommodating said movable bars, resilient return means for said movable bars in one of their end positions, means for displacing said movable bars along said radial grooves, including, for each said movable bar, a comming surface inclined relative to the axis of the drum and integral with the bearing flange of the drum, a cam follower freely slidable along said movable bar, said resilient return means urging said cam follower constantly in contact with said inclined camming surface, a slide control member for sliding said cam follower along said movable bar, and means independent of the rotational movement of said drum for simultaneously controlling the displacement of said slide control means in unison parallel to the axis of said drum.

Preferably, said inclined camming surface is a dihedral surface provided on a part extending radially outwardly of the drum, said part being integral with a triangular element in which is formed said groove in which the associated movable bar is slidable.

According to a preferred embodiment, the slide control member is forked and is disposed radially of the drum, the operative end thereof being received in a circular groove in said cam follower, all said forked slide control members being fixed on a single adjustment ring coaxial of the drum and movable parallel to the axis thereof.

According to this preferred embodiment said means for simultaneously controlling displacement comprise a movable control stem displaceable parallel to the axis of said drum, idle rollers being freely mounted at one end of said control stem and adapted to roll along opposed faces of a flange integral with said adjustment ring carrying said forked slide control members, said control stem sliding in a sleeve fixed to another rod fixed with respect to said drum, two idle rollers being mounted at one end of said other rod and adapted to roll on the opposed sides of a rim portion of said bearing flange of the drum.

With such an inter-bar spacing adjustment assembly the in-motion adjustment is effected very easily and quickly while being accurate and precise.

Figure 2:
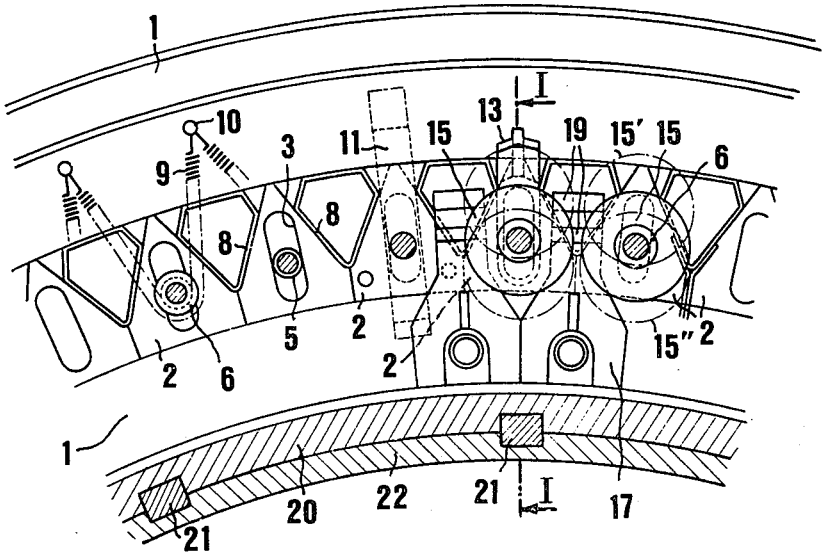

Other features and advantages of the invention will become apparent from the description of an embodiment of the invention which follows, given by way of example only, with reference to the accompanying drawings, in which:

FIG. 1 is a cross-sectional view taken on the line I—I in FIG. 2 of an embodiment of the inter-bar spacing adjustment assembly; and FIG. 2 is a detail of part of the drum of a sorting machine with the present adjustment assembly, partly in section taken on line II—II.

FIGS. 1 and 2 show part of the sorting machine comprising a drum with an annular bearing flange 1 provided with peaked or triangular insert elements or parts 2 bearing against and held on the inner face of the flange 1 by screws. The peaked elements have radial apertures or slots 3 corresponding to apertures 4 in the flange 1, for accommodating movable cylindrical bars 5 for sliding displacement.

Each of the movable bars 5 is provided at one end with a grooved pulley 6 and an idle roller 7. The rollers 7 are adapted to come into contact with a guideway (not shown) acting as a camming surface for forcing the bars, while in their upper part of their path movement, to move away from the V-shaped troughlike fixed bars 8 in the conventional manner so as to permit articles being sorted to be freed when wedged or jammed between the bars 5 and 8.

The pulleys 6 bear against springs 9 which are hooked at their ends on bolts 10 with threaded shanks fixed by nuts to the flange 1.

One face of the slots 3 is closed off by thin rectangular plates 11 with a hole for accommodating the bars 5 and movable with the bars in guideways provided on the inner faces of the peaked insert elements, these guideways being schematically represented at 12 in FIG. 1.

Each peaked element 2 is effectively continued radially outwardly by an inclined cam member 13 defining an inclined V-shaped camming surface 14, the corresponding cam follower 15 being provided with a complementary part-spherical surface for facilitating displacement along the V-shaped camming surface.

The cam followers 15 slide freely along their respective movable bars 5. The sliding movement of the cam followers 15 is imparted thereto by forked member 17 disposed between pairs of adjacent cam followers 15 so as to control the sliding movement thereof (FIG. 2).

Each forked member 17 has a rectangular portion slidable in a circular groove 18 formed in each of its associated pair of adjacent cam followers 15. In order to reduce friction contact between the forked members and the cam followers, contact is effected through cylindrical bosses 19 disposed on the forked members facing the flanks of the grooves 18 in the rollers 15.

All the forked members 17 are mounted on an adjustment ring 20 coaxial of the drum. The adjustment ring 20 is slidable parallel to the axis of the drum on guide blocks 21 fastened to a centering ring 22 which is coaxial of and fixed to the flange 1.

The adjustment ring 20 has vertical outer end flange 23 received between two idle rollers 24 mounted on pintles fastened at one end of an adjustment spindle 25.

The adjustment spindle 25 is slidable in a fixed sleeve 26 in response motion imparted by a handwheel 27 integral with a threaded section 28 cooperating with a tapped socket 29 at the outer end of the spindle 25. A guide pin 30 integral with the spindle 25 is slidable in a slot 31 formed in the sleeve 26.

The sleeve 26 is joined to another sleeve 32 in which a cylindrical rod 33 is forced fitted, the cylindrical bar being supported by a support member 34 which is fixed with respect to the drum.

The inner end of the cylindrical 33 carries two vertical pins on which a pair of idle rollers 36 are mounted, the idle rollers 36 being in rolling contact with opposed faces of a vertical rim 37 integral with the flange 1.

The operation of the inter-bar spacing adjustment assembly is as follows.

When the position of the slots 3 in the peaked insert elements or parts relative to their respective bars are to be altered, i.e., the spacing of the bars 5 with respect to the inclined flanks of the troughlike fixed bars 8, it is simply necessary to turn the handwheel 27 to translate the adjustment ring 20 parallel to the axis of the drum.

Assuming that the bars 5 are to be brought closer to the bars 8, the handwheel 27 is turned so that the adjustment ring 20 through the forked members 17 mounted thereon moves all the rollers 15 toward the right along of their respective bars 5 in FIG. 1.

The bars 5, which are constantly urged radially outwardly of the drum by springs 9, bring the cam followers 15 against the inclined camming surface 14 in such a manner that the bars 15 move closer to the outer ends of their slots 3, and therefore to the troughlike fixed bars 8.

The limit positions of the cam followers 15 corresponding to the minimum and maximum inter-bar spacing is shown in dash-dotted lines in FIG. 1. In FIG. 2 the position of the cam followers corresponding to minimum inter-bar spacing is represented in dash-dotted lines referenced 15'. Also in FIG. 2 the position of the cam followers 15 when the rollers 7 pass along the inclined surface for releasing jammed articles is shown in dash-dotted lines referenced 15".

When, on the contrary, the inter-bar spacing between bars 5 and 8 is to be increased the handwheel 27 is turned in the other direction displacing the adjustment ring 20 and forked members 17 thereon to the left in FIG. 1. In this case the inclined camming surfaces 14 force the cam followers 15 to move closer to the axis of the drum.

Preferably the cam followers 15 and the insert elements 2 as well as the cam members are made of hard plastic material, only very slightly water absorbent.

The guiding along the axis of the cam followers avoids lateral play between the bars 5 and the slots 3 in the bars 8.

The present inter-bar spacing adjustment assembly is operative while the sorting machine fitted therewith is in operation.

In fact, the displacement of the cam followers 15 is possible when the parts 1,20 and 22 are in rotation, thanks to the guiding idle rollers 24 and 36 which allow the handwheel 27, which is not rotated, to displace the adjustment ring 20 relative to the flange 1.

The adjustment of the inter-bar spacing is facilitated by the fact that the parts of the machine are in motion.

Moreover, the present assembly offers the possibility of indicating the inter-bar spacing with a pointer and graduated scale whereas in known sorting machines it is necessary to measure the inter-bar spacing directly with a gauge once the machine has been stopped.

Finally, the present invention is obviously not limited to the above described embodiment but covers all alternatives, equivalents and ,modifications within the scope of the appended claims.

What we claim is:

1. In a sorting machine for elongate articles in which fixed and movable bars are disposed alternately around a rotary drum having a bearing flange, an adjustment assembly for adjusting the spacing between said fixed and movable bars, said adjustment assembly being operative when said sorting machine is in operation and including parts with radial slots accommodating said movable bars for sliding displacement therein, means for displacing said movable bars in said slots comprising cam members associated with said movable bars and inclined with respect to the axis of the drum, means mounting said cam members on the bearing flange of the drum, cam followers freely slidably mounted on said movable bars, resilient return means constantly urging said cam followers in contact with said cam members and in a direction corresponding to a limit position of said movable bars in said radial slots, slide control members for controlling the sliding of said cam followers along said movable bars, and means independent of the rotation of the drum for displacing said slide control members in unison, parallel to the axis of the drum.

2. An adjustment assembly according to claim 1, wherein said cam members have V-shaped camming surfaces, and wherein said parts with radial slots have peaked portions extending radially outwardly with respect to the drum and being shaped complementary to said camming surfaces.

3. An adjustment assembly according to claim 1, wherein said resilient return means comprise springs secured at their ends to the bearing flange and wherein pulleys are disposed on said movable bars, said springs running over part of the periphery of said pulleys.

4. An adjustment assembly according to claim 1, wherein said slide control members are forked members disposed radially of the drum, the operative end of said forked members being in engagement with circular grooves in said cam followers.

5. An adjustment assembly according to claim 4, wherein said means for displacing said slide control members in unison comprises an adjustment ring coaxial of the drum.

6. An adjustment assembly according to claim 5, wherein said forked members are each simultaneously in engagement with said circular grooves of a pair of adjacent said cam followers.

7. An adjustment assembly according to claim 5, wherein said means for displacing said slide control members in unison also comprises a control stem movable parallel to the axis of the drum.

8. An adjustment assembly according to claim 7, wherein said adjustment ring has a flanged end and further comprising a pair of idle rollers mounted at one end of said stem and receiving said flanged end of said adjustment ring therebetween.

9. An adjustment assembly according to claim 8, wherein said stem is slidable in a sleeve which is fixed to a rod fixed independently of the drum, a pair of idle rollers mounted at one end of said rod and receiving a rim or the bearing flange of the drum therebetween.

* * * * *